United States Patent [19]

Bennett

[11] 4,311,229

[45] Jan. 19, 1982

[54] APPARATUS FOR HANDLING ROD-LIKE ARTICLES

[75] Inventor: George Bennett, London, England

[73] Assignee: Molins Limited, London, England

[21] Appl. No.: 721,227

[22] Filed: Sep. 8, 1976

[30] Foreign Application Priority Data

Sep. 18, 1975 [GB] United Kingdom ..... 38344
Dec. 1, 1975 [GB] United Kingdom ..... 49268

[51] Int. Cl.[3] ..... B65G 47/26
[52] U.S. Cl. ..... 198/457; 198/493
[58] Field of Search ..... 198/347, 431, 457, 461, 198/462, 471, 483, 493, 599, 611, 612, 626, 636, 637, 689, 951, 392, 380, 502, 572, 956; 302/2 R

[56] References Cited

U.S. PATENT DOCUMENTS

| | | | |
|---|---|---|---|
| Re. 28,383 | 4/1975 | Rudszinat | 198/457 |
| 2,512,083 | 6/1950 | Bardet | 198/457 |
| 2,966,253 | 12/1960 | Gerrans | 198/572 |
| 3,077,264 | 2/1963 | Molins et al. | 198/689 |
| 3,166,312 | 1/1965 | Rehm | 198/689 |
| 3,217,859 | 11/1965 | Bartlo et al. | 198/425 |
| 3,222,110 | 12/1965 | Kelly et al. | 302/2 R |
| 3,305,128 | 2/1967 | Dearsley | 198/347 |
| 3,330,403 | 7/1967 | Roberts et al. | 198/392 |
| 3,397,922 | 8/1968 | Dearsley | 302/2 R |
| 3,404,921 | 10/1968 | Vergales et al. | 302/2 R |
| 3,419,015 | 12/1968 | Wochnowski | 131/135 |
| 3,465,869 | 9/1969 | Benatar | 198/502 |
| 3,707,217 | 12/1972 | Sharbon | 198/380 |
| 3,853,016 | 12/1974 | Lane et al. | 198/626 |
| 3,885,683 | 5/1975 | Bornfleth et al. | 198/347 |
| 3,921,790 | 11/1975 | Hinchcliffe et al. | 198/347 |

FOREIGN PATENT DOCUMENTS

| | | | |
|---|---|---|---|
| 2353806 | 5/1974 | Fed. Rep. of Germany . | |
| 2500526 | 9/1975 | Fed. Rep. of Germany | 198/347 |
| 759948 | 2/1934 | France | 198/493 |
| 778043 | 7/1957 | United Kingdom | 198/493 |
| 1161601 | 8/1969 | United Kingdom | 198/611 |
| 1410473 | 10/1975 | United Kingdom | 198/461 |

*Primary Examiner*—Joseph E. Valenza
*Attorney, Agent, or Firm*—Craig and Antonelli

[57] ABSTRACT

A receiver unit for a pneumatic plug feed is adapted to feed the rods away transversely as a stack. Each successive leading rod is accelerated towards retarding means and then deflected sideways by means of one or more air jets and possibly also by a conveyor which engages the trailing end of the rod and quickly moves it out of the forward path of the next rod. Conveyor means for the stack may be arranged to move the rods into a magazine underneath a considerable "head" of rods.

22 Claims, 8 Drawing Figures

APPARATUS FOR HANDLING ROD-LIKE ARTICLES

Figure 1:
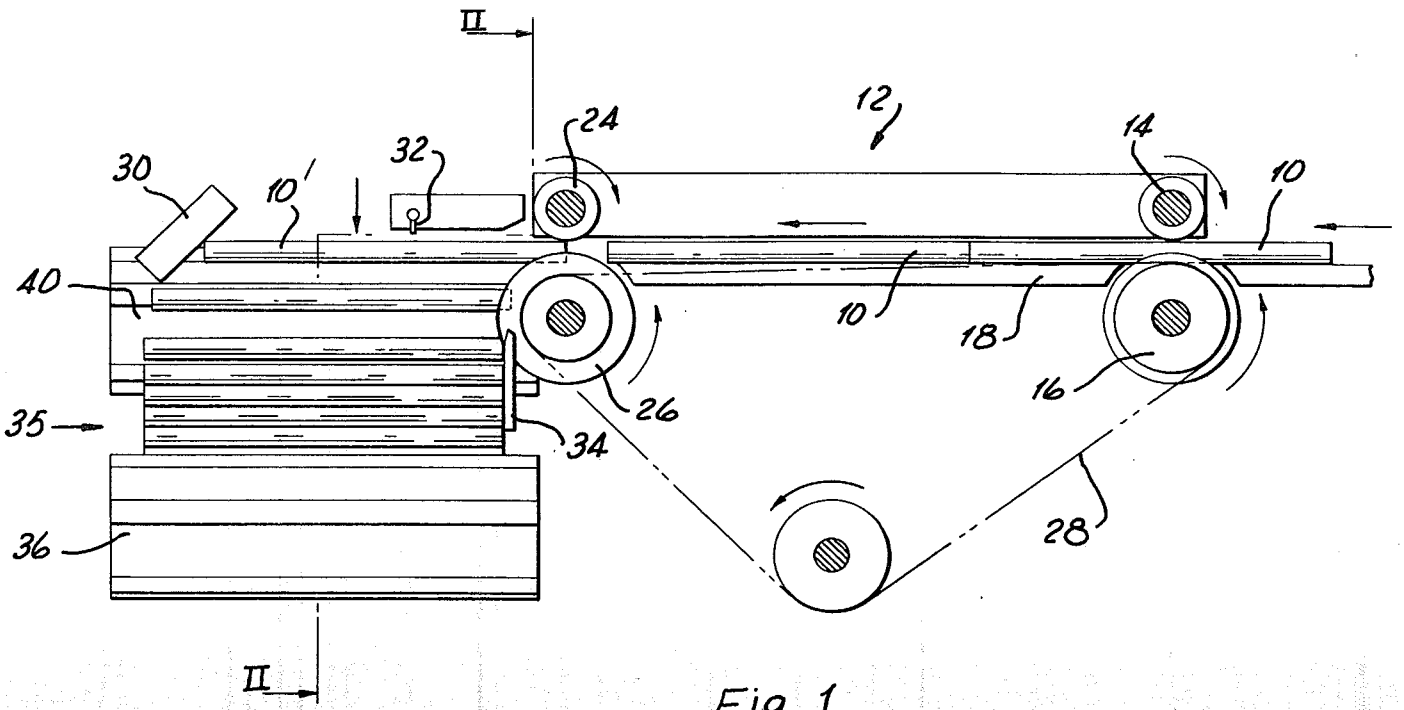

This invention relates to apparatus for handling rod-like articles, and is particularly concerned with a device suitable for use as a receiver unit for a pneumatic conveying system for such articles.

Pneumatic conveying systems in which rod-like articles are conveyed axially in line through a conduit from a distributing unit to a receiver unit by means of pressure air are well known in the tobacco industry and are commonly used for conveying filter rod lengths from a filter rod making machine to one or more machines for attaching filters to tobacco lengths to produce filter cigarettes. An example of such a system is disclosed in British patent specification No. 1,093,261.

According to the present invention a device for receiving an endwise-moving line of rod-like articles includes means for retarding axial movement of successive leading articles and means for conveying rod-like articles away as a stream consisting of a stack of the articles moving transverse to their lengths. The device may include means for deflecting sideways each successive leading article to a stack forming region.

The deflecting means may include an air jet and/or an inclined deflecting surface (which latter forms at least part of the retarding means). The deflecting means may also include means engaging the trailing end of the leading rod-like article, to move this end quickly out of the forward path of the next rod-like article. In this case the trailing end may be engaged, at a different angular position, by a rotary conveyor which also feeds the rod-like articles in line. This conveyor may be one of a pair of conveyors which accelerate the leading rod-like article towards the retarding means so as to create or increase a gap between it and the next article in the line.

In a preferred arrangement the stack of rod-like articles is formed on a band conveyor immediately beneath the position where in line motion of the articles is stopped. Successive leading articles are deflected sideways into a channel above the conveyor, the channel being slightly wider than the length of one of the rod-like articles and having a depth of several article diameters. The conveyor is arranged transverse to the direction of movement of the line of endwise-moving articles received by the device and is operable to move a stack transversely away. The stack conveyor may cooperate with a synchronised top band and may be arranged to feed the stack into a magazine, e.g. to the hopper of a plug assembler if the rod-like articles are filter rod lengths.

The device is intended primarily for use as a receiver unit for a pneumatic conveying system for rod-like articles such as filter rod lengths. In such a system the speeds of the rod-like articles in the conduits can be very high. The receiver unit therefore preferably includes primary retarding means, which may be in the form of one or more opposed cooperating conveyors, to slow the rod-like articles from their high pneumatic speed and to feed a line of endwise-moving articles forward at a controlled lower speed.

Figure 2:
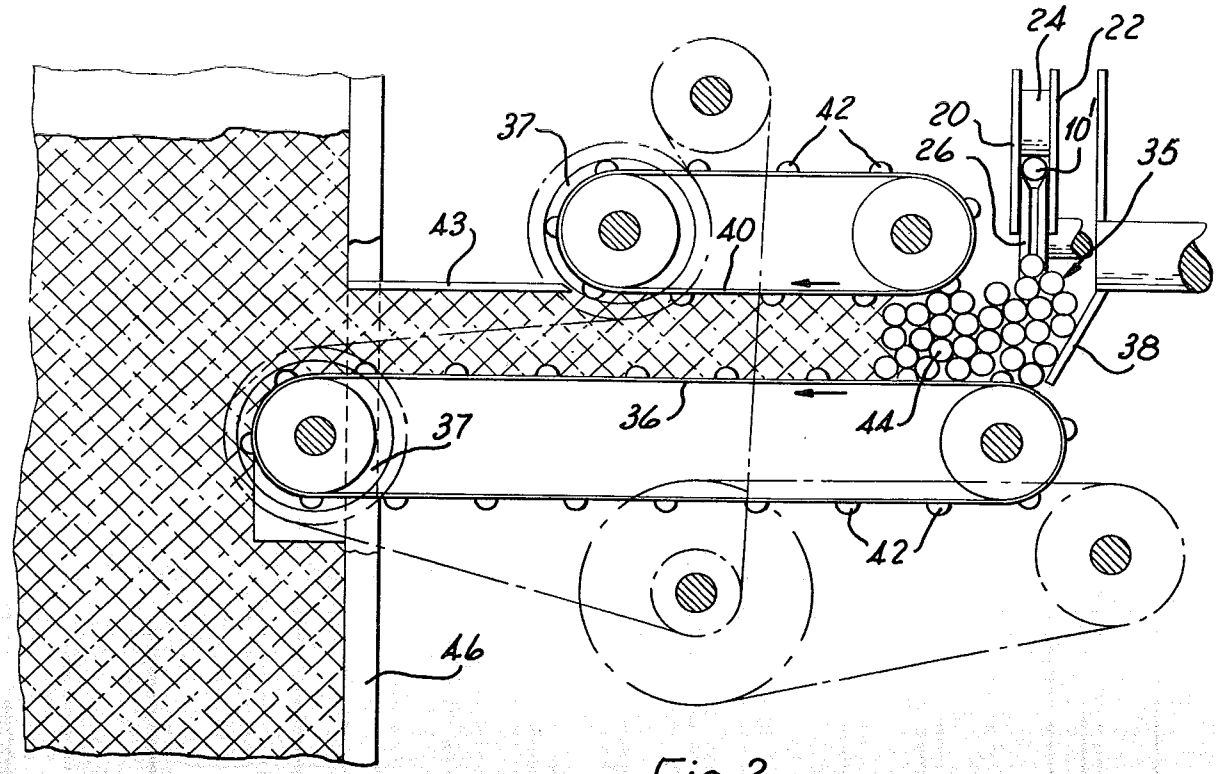
Figure 3:
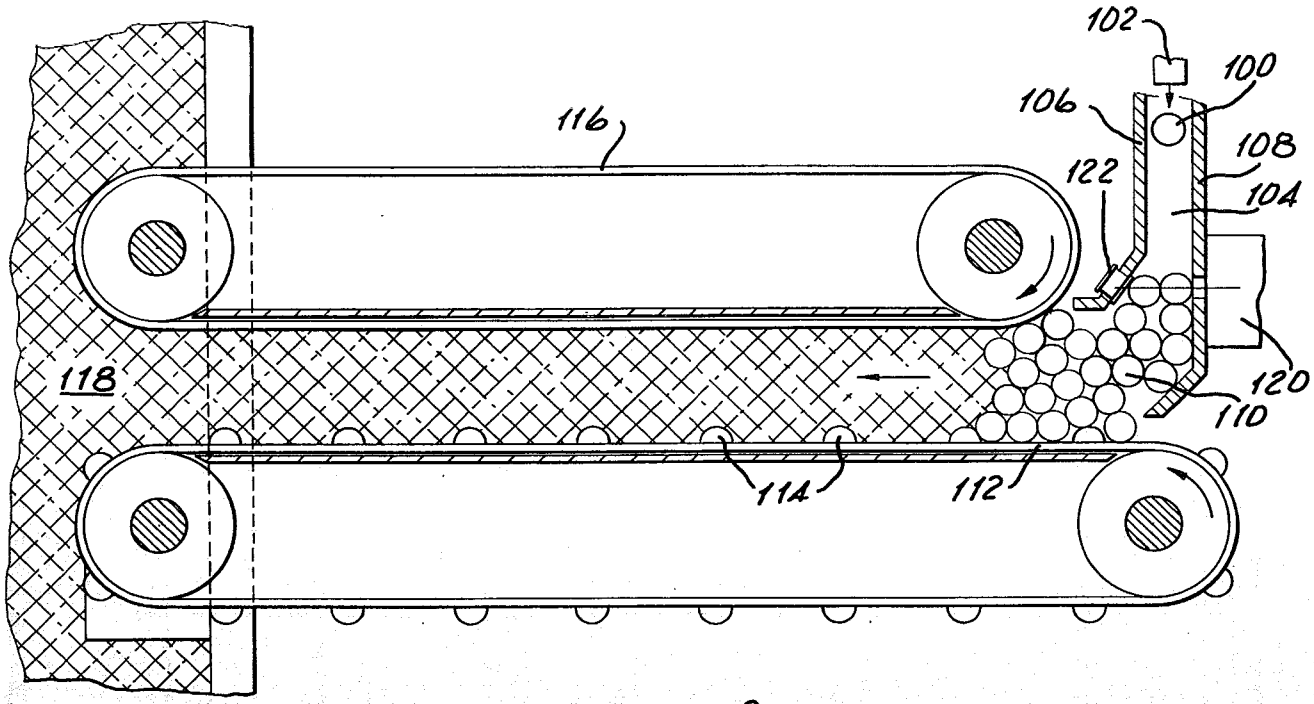
Figure 4:
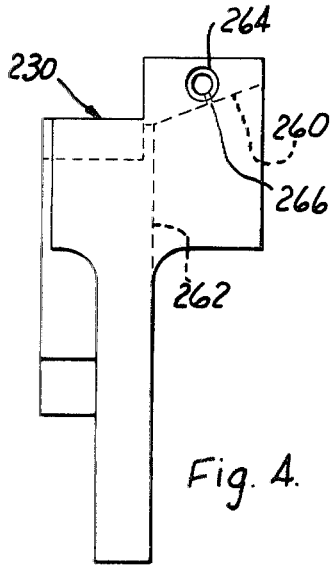
Figure 5:
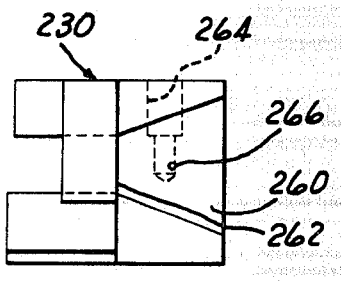
Figure 6:
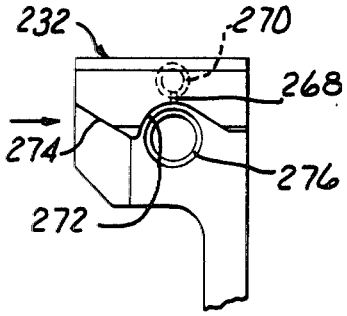
Figure 7:
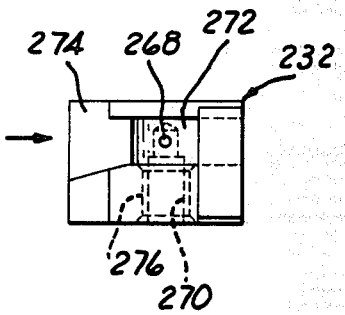
Figure 8:
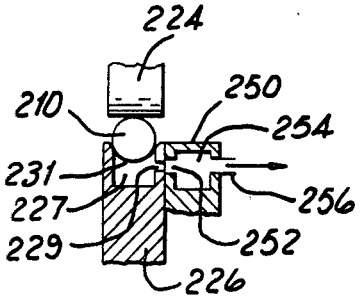

The invention will now be further described by way of example with reference to the accompanying drawings in which:

FIG. 1 is a diagrammatic side view of a receiver unit of a pneumatic conveying system for filter rod lengths, FIG. 2 is a sectional view of the receiver unit on the line II—II of FIG. 1, and showing part of a magazine fed by the unit, FIG. 3 is a view, similar to FIG. 2, of a modified receiver unit, FIG. 4 is a side view of an assembly including retarding means and air deflecting means, for use with a receiver unit, FIG. 5 is a bottom view of the assembly of FIG. 4, FIG. 6 is a side view of an air deflecting assembly for use with a receiver unit, FIG. 7 is a bottom view of the assembly of FIG. 6, and FIG. 8 is a sectional view of a suction conveyor for use with a receiver unit.

Filter rod lengths 10 are delivered pneumatically to a receiving device indicated generally at 12 from a conduit (not shown) in which they are moved in an endwise direction. Filter rods are conveniently handled in multiple lengths, such as the rods 10 which are six times the length of a single filter for use in an individual cigarette. The rods 10 are received between a freely rotatable upper roller 14 having a flat guide surface and a driven lower roller 16 having a V-surface. The roller 16 is driven at a controlled speed so that the rods 10 are fed forward at a speed slower than that at which they are normally conveyed in the pneumatic conduit. The rollers 14 and 16 may themselves act as the braking means whereby the speed of the rods is reduced or they may simply receive rods from a previous braking means. In either case in normal operation it is preferred to operate the distributor feeding the conduit and the receiver at such rates that there are gaps between adjacent rods passing through the rollers, i.e. so that a line of abutting rods stretching back from the rollers is avoided.

Lengths 10 received between the rollers 14 and 16 are conveyed forward over a stationary plate 18 and between vertical guide surfaces 20 and 22 (FIG. 2) towards a second pair of rollers 24 and 26. As before, the upper roller 24 is freely rotatable and has a flat guide surface and the lower roller 26 is driven and has a V-shaped surface so that each rod is contacted at three angularly spaced positions. The drive for the rollers 16 and 26 is common, being by way of a pulley belt 28, but the radius at which the belt acts is less on the roller 26 than on the roller 16, with the result that the peripheral speed of roller 26 is higher than that of roller 16. This has the effect of accelerating the leading rod 10' away from the next rod to increase (or possibly create) a gap in the line.

Retarding means in the form of an inclined plate 30 in the path of the rod 10' is spaced from the plane through the axes of rollers 24 and 26 by a distance slightly greater than the length of the rod 10'. On impact the forward end of the rod 10' is deflected downwards. The trailing end of the rod is also deflected downwards by means of air jets directed from one or more nozzles 32. The roller 26 is so positioned that the trailing end of the rod 10' is again engaged between the V-surfaces of the roller and conveyed downwards. Thus there are three agencies which tend to produce downward movement of the rod 10'; these may be balanced in such a way that the rod remains approximately level.

It may not be necessary to involve all three of said agencies to produce effective deflection of the leading rod 10' and it is possible that one or more could be omitted. For example, if the retarding means comprises a plate which is normal to the line of rods rather than inclined, the degree of bounce to which the rods are subjected is increased and the effect of the downward thrust caused by engagement with the V-groove of roller 26 is thereby likely to be increased. In this respect it may be noted that it is more important that the trailing end of a rod should be quickly deflected out of line than the leading end since it is of course the trailing end which is nearer to the next rod in line. One or more additional air jets could be used if it is required also to quickly defect the leading end of a rod so that the rod still remains approximately level.

The retarding means comprising inclined plate 30 is instrumental in stopping axial movement of the rods 10'. A guide plate 34 determines the limit of the axial position of the trailing end of the rods deflected downwards. The plate 34 has bevelled upper edge to aid in stripping the ends of the deflected rods from the roller 26. A similar plate may be positioned at an axial spacing of slightly greater than a rod length to determine the position of the leading end.

The rods 10' fall into a stack forming region 35 situated over the end of an endless band conveyor 36 and defined between a stationary inclined end plate 38 and an endless band top conveyor 40. Each of the conveyors 36 and 40 is provided with half round ribs 42 for positive control of the rods and in order to help initial forming of the stack 44. Satisfactory stack forming can be obtained even if the top band conveyor 40 is not provided with ribs. The downstream pulleys for the conveyors 36 and 40 are provided with stripper wheels 37, having an overall diameter equal to or slightly exceeding that of the locus of the ribs around the respective pulley, to prevent rods being carried around the pulleys by the ribbed bands.

The speeds of conveyors 36 and 40 are synchronised and may be variable in response to a sensor (not shown) which responds to the level in the stack forming region. Thus the conveyors 36 and 40 may be stationary until a sufficient height of rods has built up in the stack forming region to activate the sensor and operate the drive for the conveyors. The stack 42 is then conveyed in a direction transverse to the lengths of the rods between the conveyors 36 and 40 (and subsequently by the conveyor 36 alone underneath a dead plate 43) to a magazine 46 (which may form the hopper of a filter attachment machine).

Referring now to FIG. 3, rods 100 are received and deflected downwards by means of air jets from nozzles 102 as before. The rods 100 then pass through a channel 104 formed between side plates 106, 108. The width of the channel 104 only slightly exceeds the diameter of a rod 100. The channel 104 leads to a stack forming region 110 over the end of an endless band conveyor 112 provided with half-round ribs 114. The conveyor 112 is in accordance with an invention described in our British patent application No. 49787/72 (and equivalent German OS No. 23 53 806.9).

A stack formed on the conveyor 112 is conveyed to the left as viewed in FIG. 3 underneath a plain drive band 116 into a magazine 118. The stack conveyed by the conveyors 112 and 116 (and also that on conveyor 36 of FIGS. 1 and 2) may be inserted into a magazine already containing rods to a level above that of the entry point of the stack. In other words the stack from the receiver unit may be inserted into the magazine underneath a "head" of rods in the magazine. The conveyors 112 and 116 may extend into the magazine.

A beam of light is directed by a light source 120 towards a photo-electric detector 122. As long as no light reaches the detector 122 the conveyors 114, 116 are driven continuously. When the level of the accumulated rods in the stack forming region drops so as to allow the light beam to reach the detector 122, the conveyors 114, 116 are automatically stopped. The drive control system for the conveyors 114, 116 may have a built-in delay such that the drive for the conveyors 114, 116 is only switched on when the light beam is interrupted for at least a predetermined time, i.e. so that the drive is not switched on in response to the instantaneous interruption of the light beam by a rod moving downwards past the detector.

Although the units shown in the drawings are intended for use with air jets for deflecting the rods 10, 100, other known means for causing sideways motion of the rods delivered to the units could be used, either alone or in combination with air jets. Thus one or more conveyors such as bands or rollers could impart sideways motion. One arrangement would be to deflect the axially moving rods sideways (for example by means of air jets) into a channel defined at least on one side by a transversely moving conveyor, the width of the channel being slightly less than the diameter of the rods.

A modified form of retarding means for use with a receiver unit is shown in FIGS. 4 and 5 and comprises an assembly 230 for attachment in a position corresponding approximately with that of inclined plate 30 in FIG. 1. The assembly 230 includes an inclined deflecting surface 260 and a flat surface 262 which is perpendicular to the axial movement of the rod-like articles through the receiver unit. A bore 264 is provided at the side of the assembly 230 for connection of an air pressure supply to a nozzle 266 centrally placed in surface 260. The leading ends of rod-like articles travelling towards the assembly 230 (from the right as viewed in the drawing) are deflected downwards by the air jet from nozzle 266 and by contact (if any) with the inclined surface 260. Axial movement is stopped by surface 262.

FIGS. 6 and 7 show an air deflecting assembly 232 corresponding to a modified form of the unit incorporating the air jet nozzle 32 of FIG. 1. The assembly 232 includes an air jet nozzle 268 connected for supply of pressure air through a side bore 270 and situated in a recess 272. As shown in the drawings the assembly 232 is arranged to deflect rod-like articles coming from the left and has an inclined leading surface 274 so that the articles are guided past the recess 272. This arrangement ensures that the rod-like articles are spaced slightly away from the nozzle 268 and avoids any undesirable suction due to the Coanda effect (which effectively could cause the rods to be deflected upwards contrary to the intention). A port 276 is provided in the side of the assembly 232 adjacent the recess 272: this further improves the air flow and the port may be connected to air flow means for withdrawing air from the region of the recess. More than one nozzle 268 could be provided, e.g. two nozzles side by side can be used.

FIG. 8 shows a modified conveyor wheel 226 which could take the place of one or both of the wheels 16, 26 in the FIG. 1 arrangement. Instead of a V-shaped recessed periphery the wheel 226 has a curved surface 231 adapted to the diameter of the rod-like articles 210. As before the wheel 226 cooperates with an upper wheel 224 having a cylindrical periphery. The surface 231 is arranged with vents connecting to a peripheral suction chamber 227 in the wheel 226. The chamber 227 has one or more ports 229 for connection to a suction port 252 and manifold 254 in a stationary member 250 arranged alongside the wheel 226. Suction is supplied to the manifold 254 through a pipe 256. By providing suction to the conveyor wheels of the receiver unit good control of the rod-like articles is achieved with a U shaped wheel periphery which causes less deformation of the rod-like articles than a V-shaped periphery. It will be realised that suction is required to be supplied to a wheel 226 of a receiver unit over only a part of its angle of rotation (e.g. over the top 45° to 50° in the case of a wheel in the position of wheel 16 of FIG. 1 and over a rather greater angle in the case of a wheel corresponding to wheel 26—in order to provide additional control for downward deflection of the trailing ends of the rod-like articles). Precise control of suction over angles of rotation of less than 360° can be obtained by using multiple ports and sub-dividing the suction chamber 227 by means of vanes. One arrangement for controlling suction in this way is disclosed in British Patent Specification No. 1,396,318.

I claim:

1. A device for receiving endwise-moving rod-like articles including means defining an axial first path for said articles, means for retarding axial movement of successive leading articles along a portion of of said first path, a stack forming region for receiving said articles from said retarding means, means including spaced surfaces defining a transverse second path for conveying said articles away from said region as a stream consisting of a multi-layer stack of articles moving transverse to their lengths, at least one of said surfaces consisting of movable conveyor means, channel means including a channel having a width about the same as the diameter of a rod-like article for guiding articles downwards from said first path towards said stack forming region, said stack forming region being positioned between said first path and said conveyor means so that articles delivered through said channel means may be received on top of a stack on said conveyor means, deflecting means for transversely deflecting each successive leading article from said first path through said channel into said stack forming region, including means for separately deflecting the trailing end of each article into said channel, sensor means arranged to monitor the level of articles in said stack forming region between said first and second paths, and means for controlling said conveyor means in response to signals derived from said sensor means so that said stack of articles in said second path is maintained at a substantially predetermined constant height, wherein said retarding means includes an inclined surface at the end of said first path and means for directing an air jet from said inclined surface to deflect said rod-like article into said channel.

2. A device for receiving endwise-moving rod-like articles including means defining an axial first path for said articles, means for retarding axial movement successive leading articles along a portion of said first path, a stack forming region for receiving said articles from said retarding means, means including spaced surfaces defining a transverse second path for conveying said articles away from said region as a stream consisting of a multi-layer stack of articles moving transverse to their lengths, at least one of said surfaces consisting of movable conveyor means, channel means including a channel having a width about the same as the diameter of a rod-like article for guiding articles downwards from said first path towards said stack forming region, said stack forming region being positioned between said first path and said conveyor means so that articles delivered through said channel means may be received on top of a stack on said conveyor means, deflecting means for transversely deflecting each successive leading article from said first path through said channel into said stack forming region, including means for separately deflecting the trailing end of each article into said channel, sensor means arranged to monitor the level of articles in said stack forming region between said first and second paths, and means for controlling said conveyor means in response to signals derived from said sensor means so that said stack of articles in said second path is maintained at a substantially predetermined constant height, wherein said deflecting means includes second means arranged with respect to said retarding means to engage the trailing end of each successive leading rod-like articles to deflect said trailing end transversely after the leading end contacts said retarding means, and first means arranged to direct the trailing end of each article towards said second means.

3. A device as claimed in claim 2 wherein said second deflecting means includes a rotary conveyor provided with a circumferential peripheral groove for engaging said trailing end.

4. A device as claimed in claim 3 including suction means for supplying suction to said peripheral groove.

5. A device as claimed in claim 3 wherein said rotary conveyor is one of a pair of conveyors arranged adjacent said axial path for accelerating rod-like articles towards said retarding means to space successive articles apart.

6. A device for receiving endwise-moving rod-like articles including means defining an axial first path for said articles, means for retarding axial movement of successive leading articles along a portion of said first path, a stack forming region for receiving said articles from said retarding means, means including spaced surfaces defining a transverse second path for conveying said articles away from said region as a stream consisting of a multi-layer stack of articles moving transverse to their lengths, at least one of said surfaces consisting of movable conveyor means, channel means including a channel having a width about the same as the diameter of a rod-like article for guiding articles downwards from said first path towards said stack forming region, said stack forming region being positioned between said first path and said conveyor means so that articles delivered through said channel means may be received on top of a stack on said conveyor means, deflecting means for transversely deflecting each successive leading article from said first path through said channel into said stack forming region, including means for separately deflecting the trailing end of each article into said channel, sensor means arranged to monitor the level of articles in said stack forming region between said first and second paths, and means for controlling said conveyor means in response to signals derived from said sensor means so that said stack of articles in said second path is maintained at a substantially predetermined constant height, wherein the deflecting means includes second deflecting means arranged with respect to said retarding means to engage the trailing end of each successive leading rodlike article to deflect said trailing end transversely after the leading end contacts said retarding means, and air jet directing means arranged to direct said trailing end towards engagement with said second deflecting means.

7. A device as claimed in claim 6 wherein said retarding means includes an inclined guide surface which forms part of said deflecting means.

8. A device as claimed in claim 7 including means for directing an air jet from said inclined surface.

9. A device for receiving endwise-moving rod-like articles including means defining an axial first path for said article; a retarding surface for retarding axial movement along a portion of said first path; a rotary conveyor means arranged adjacent said first path for engaging said articles at a first angular position and for conveying said articles on said path; first deflecting means including means for directing at least one transverse air jet across said axial path; second deflecting means comprising said rotary conveyor provided with a circumferential peripheral groove for engaging the trailing end of each successive leading rod-like article to deflect said trailing end transversely after the leading end contacts said retarding surface; said first deflecting means being arranged to deflect the trailing end of each article towards said second deflecting means and by a greater amount than the leading end, whereby said trailing end is positively engaged by the peripheral groove of said second deflecting means; a stack-forming region for receiving articles deflected by said first end second deflecting means; and endless band conveyor means defining a transverse second path for conveying said articles away from the stack-forming region as a stream consisting of a stack of articles moving transverse to their lengths, said conveyor means including spaced protrusions for conveying said stack.

10. A device as claimed in claim 9 including a magazine for rod-like articles including an inlet located at a level below the normal operating surface level of rod-like articles in the magazine, said second path extending to said inlet and said inlet being of about the same width as said path.

11. A device as claimed in claim 10 wherein said conveyor means projects through said inlet so that said second path extends into said magazine.

12. A device as claimed in claim 11 wherein said conveyor means comprises spaced upper and lower parallel band conveyors extending into said magazine.

13. A device as claimed in claim 9 including means for applying suction to said peripheral groove over a first angular region for conveying said articles on said axial first path and for applying suction to said peripheral groove over a second angular region for deflecting the trailing ends of said articles away from said path.

14. A device as claimed in claim 9 wherein said retarding surface is arranged substantially at right angles to said axial first path and positioned so that the trailing ends of articles retarded by said retarding surface are directed towards said second deflecting means.

15. A device as claimed in claim 14 wherein said air jet means is positioned relative to said retarding surface so that the trailing ends of said articles are directed by an air jet towards said secondary deflecting means.

16. A device as claimed in claim 9 including guide means for maintaining a spacing between the path of said rod-like articles and said air jet directing means, said guide means including an inclined guide surface and a recess, said air jet directing means being located in said recess.

17. A device as claimed in claim 9 including retarding means comprising a surface arranged substantially at right angles to said axial first path, said deflecting means comprising a further surface inclined to said surface and to said axial path, and means for directing an air jet substantially at right angles to said further surface.

18. A device as claimed in claim 9 including sensor means arranged to monitor the level of articles in said stack forming region between said first and second paths, and means for controlling said endless band conveyor means in response to signals derived from said sensor means so that a stack of substantially constant height is maintained on said second path.

19. A device for receiving endwise-moving rod-like articles including means defining an axial first path for said articles; means for retarding axial movement of successive leading articles; means for deflecting transversely each successive leading article including means for separately deflecting the trailing end of each article out of said first path; a stack forming region for receiving said articles; spaced parallel upper and lower endless band conveyors for conveying said articles away from said region as a stream consisting of a stack of articles moving transverse to their lengths, at least one of said conveyors including spaced protrusions for conveying said stack; and a magazine for rod-like articles including an inlet located at a level below the normal operating surface level of rod-like articles in the magazine; pulley means for said upper and said lower conveyors positioned within said magazine, said upper and lower endless conveyors extending through said inlet and around said pulley means in said magazine so that said stack may be conveyed between said upper and lower conveyors through and beyond said inlet into said magazine.

20. A device for receiving endwise-moving rod-like articles including means defining an axial path for said articles; means for retarding axial movement of successive leading articles; pneumatic means for causing a differential air flow adjacent each successive leading article whereby the trailing end of each article is deflected transversely out of said path more rapidly than the leading end; a stack forming region for receiving said articles; endless conveyor means for conveying said articles away from said region as a stream consisting of a stack of articles moving transverse to their lengths; sensor means arranged to monitor the level of articles in said stack forming region; and means for controlling said endless conveyor means to maintain the level of said stack substantially constant in response to signals derived from said sensor means.

21. A device as claimed in claim 20 wherein said pneumatic means includes means for directing an air jet at said trailing end.

22. A device as claimed in claim 20 wherein said pneumatic means includes a rotary suction conveyor.

* * * * *